United States Patent [19]

McCarthy

[11] 4,068,761

[45] Jan. 17, 1978

[54] APPARATUS FOR SUPPORTING AND DISPLAYING PLANTS

[76] Inventor: James H. McCarthy, 103 W. Rustic Lodge, Minneapolis, Minn. 55409

[21] Appl. No.: 718,592

[22] Filed: Aug. 30, 1976

[51] Int. Cl.[2] ..... A47G 7/00

[52] U.S. Cl. ..... 211/134; 47/40; 248/354 P; 248/356

[58] Field of Search ..... 248/354 R, 354 P, 356, 248/125, 235, 243, 122, 121; 47/36, 40; 403/296; 211/205, 90, 196, 144, 131, 134

[56] References Cited

U.S. PATENT DOCUMENTS

| | | | |
|---|---|---|---|
| 312,159 | 2/1885 | Perkins | 47/40 |
| 422,297 | 2/1890 | Covington | 47/40 |
| 3,204,779 | 9/1965 | Warner | 211/205 X |
| 3,319,378 | 5/1967 | Andrews et al. | 47/40 |
| 3,471,112 | 10/1969 | MacDonald et al. | 248/243 X |
| 3,479,990 | 11/1969 | Crow | 248/356 X |
| 3,574,980 | 4/1971 | Keller | 248/243 X |

FOREIGN PATENT DOCUMENTS

| | | | |
|---|---|---|---|
| 167,805 | 8/1950 | Germany | 248/356 |

*Primary Examiner*—J. Franklin Foss
*Attorney, Agent, or Firm*—John W. Adams

[57] ABSTRACT

An apparatus for supporting and displaying plants in a window, that is readily adaptable to windows of various sizes and provides not only relocatable supporting platforms for potted plants but also relocatable pegs from which hanging plants may be displayed.

3 Claims, 4 Drawing Figures

APPARATUS FOR SUPPORTING AND DISPLAYING PLANTS

BACKGROUND OF THE INVENTION

It is desirable to expose certain types of potted plants to sunlight whenever possible. In the past it has been necessary to sacrifice room space for a floor mounted plant stand or place the potted plants directly on the window sill or an apparatus attached to the window. With these approaches, the plants were prone to being upset whenever the window was operated.

These plant display techniques are covered by U.S. Patents as follows:

Perkins U.S. Pat. No. 312,159 Lindstrom U.S. Pat. No. 3,007,582

Wittbold U.S. Pat. No. 816,053 Richardson U.S. Pat. No. 3,108,401

Koch U.S. Pat. No. 2,187,159 Kramer U.S. Pat. No. 1,181,828

McCarroll U.S. Pat. No. 2,029,246 Crow U.S. Pat. No. 3,479,990

The novel features which are characteristic of the apparatus of the present invention overcome these shortcomings as well as offering numerous additional advantages by providing an upstanding supporting post member adapted to be secured in a substantially vertical manner in a window. The post provides a plurality of mounting elevations in which either a plant supporting platform or a peg for hangling plants may be positioned and secured. It is vitally important to secure the plant supporting platforms to the post at the desired elevation and in a manner that will positively prevent rotation of the platform when a plant is placed thereon.

The following is a description of the specific embodiment of this invention illustrated in the accompanying drawings wherein like reference characters refer to similar parts throughout the views, in which.

Figure 1:
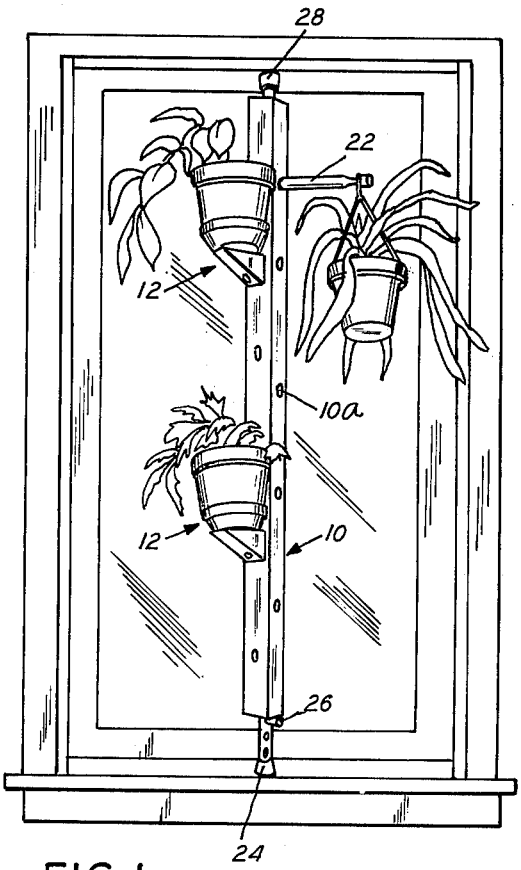
FIG. 1 is a perspective view illustrating the plant stand installed in a window.
Figure 2:
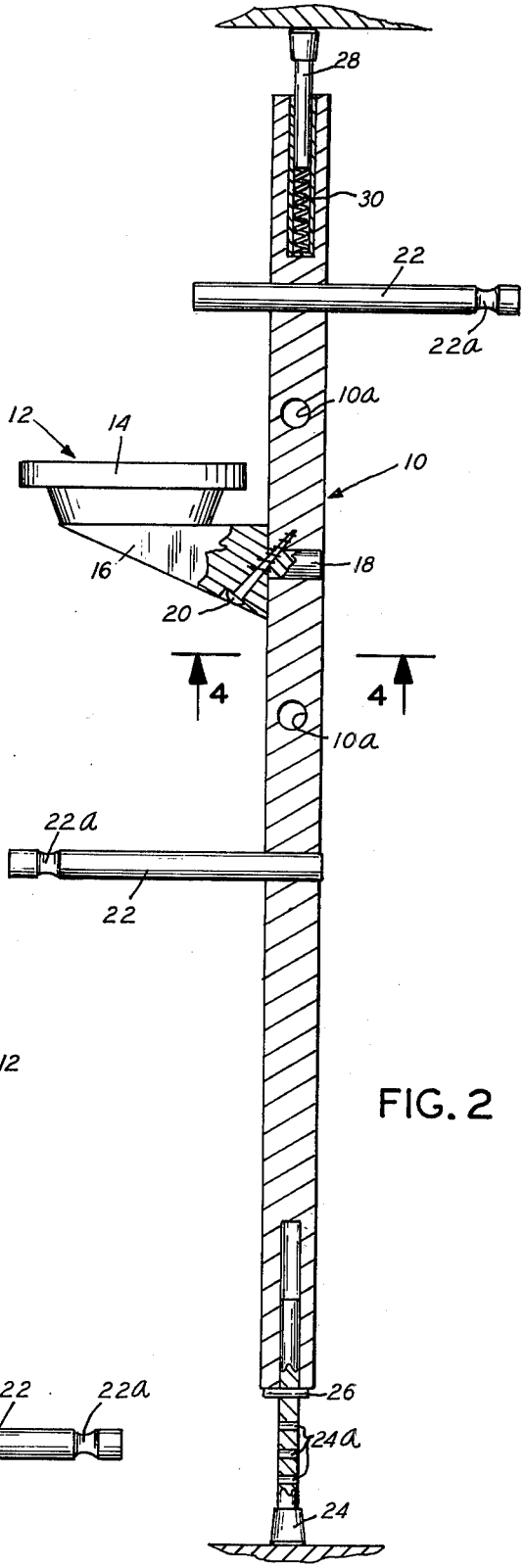
FIG. 2 is a vertical sectional view of the plant stand illustrating the post length adjusting detail and the detail of the platform anchoring means.
Figure 3:
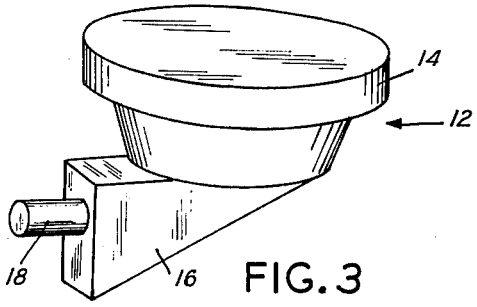
FIG. 3 is a perspective view of a plant supporting platform.
Figure 4:
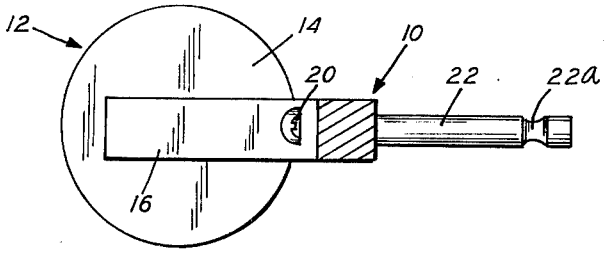
FIG. 4 is a sectional view taken substantially along viewing line 4—4 of FIG. 2.

In the form of the invention illustrated an elongated post 10 is provided having a plurality of longitudinally spaced apart generally transversely oriented dowel-receiving mounting holes **10*a* formed therein. A plant supporting and displaying platform assembly 12 is provided and includes a tray 14 with a supporting arm 16 fixed thereto, which in turn has a connecting dowel 18 fixed in outstanding relation thereto. The post 10 may be mounted between a pair of vertically spaced apart support members such as the upper and lower frame member of a window. A lower foot element 24 is axially received in the bottom of the post 10 and has a plurality of spaced apart adjustment holes 24*a* formed therein to receive a screw pin 26 which permits adjustment of the outwardly extending portion of said foot below the post. The upper end of the post 10 has a telescopically receiving foot member 28** resilently urged upwardly to engage against the head of a window casing as shown.

When the post 10 has been mounted in upstanding relation in the desired position within a window, a number of platform assemblies 12 may be mounted thereon at the desired elevations by selectively inserting the connecting dowel 18 into one of the holes **10*a* in the post. The arm 16 is generally triangular member as viewed in elevation and the dowel 18 extends outwardly forming intermediate portion of the enlarged base of the triangular arm 16 which abuts the surfaces of the post surrounding the selected hole 10*a* into which the dowel is inserted. The dowel and platform assembly are positively anchored to the post by inserting a screw 20 upwardly diagonally through a base portion of the arm 16, upwardly through the dowel and into the portion of the post surrounding the dowel and disposed thereabove. The anchoring screw 20** not only prevents dowel from coming out of the post but also prevents rotation of the dowel and platform with respect to the post while still permitting easy removal thereof.

Elongated pegs 22 are provided for supporting hanging plants as illustrated and the suspension elements of the hanging plants are retained on the end of said peg as by a groove **22*a***.

It will, of course, be understood that various changes may be made in the form, details, arrangement and proportions of the parts without departing from the scope of this invention, which generally stated is set forth in the appended claims.

What is claimed is:

1. An apparatus for supporting and displaying plants comprising:

an upstanding elongated post member with means for anchoring the same at the top and the bottom and having a plurality of holes formed therein, at least one plant supporting platform having a connecting dowel means on one end to be received in a selected hole, and anchoring means radially offset from the selected hole and connecting said platform and said post for securely holding said dowel in the selected post hole to prevent rotation thereof.

2. The structure set forth claim 1 and said anchoring means constituting a locking screw inserted diagonally through said dowel and into a portion of the post surrounding the selected hole.

3. The structure set forth in claim 1 and said supporting platform including a tray with a supporting arm fixed thereto, said dowel means being fixed to said arm above the lower portion thereof and extending downwardly from the arm into a selected hole in said post member, and said anchoring means comprising an anchoring screw extending through the lower portion of said arm disposed below the dowel and into said post.

* * * * *